US009518587B2

(12) United States Patent
Yokota et al.

(10) Patent No.: US 9,518,587 B2
(45) Date of Patent: Dec. 13, 2016

(54) AIR COMPRESSOR

(75) Inventors: Tomoyoshi Yokota, Hitachinaka (JP); Seiichi Kodato, Hitachinaka (JP); Hiroki Kitagawa, Hitachinaka (JP); Kenichi Matsunaga, Hitachinaka (JP); Masahiro Miura, Hitachinaka (JP); Yoshimi Takahashi, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 155 days.

(21) Appl. No.: 14/130,540

(22) PCT Filed: Aug. 28, 2012

(86) PCT No.: PCT/JP2012/005405

§ 371 (c)(1),
(2), (4) Date: Jan. 2, 2014

(87) PCT Pub. No.: WO2013/042318

PCT Pub. Date: Mar. 28, 2013

(65) Prior Publication Data

US 2014/0186193 A1 Jul. 3, 2014

(30) Foreign Application Priority Data

Sep. 22, 2011 (JP) ..... 2011-207156
Sep. 22, 2011 (JP) ..... 2011-207157

(51) Int. Cl.

| | |
|---|---|
| ***F04D 25/06*** | (2006.01) |
| ***F04B 49/08*** | (2006.01) |
| ***F04C 14/00*** | (2006.01) |
| ***F04B 41/02*** | (2006.01) |
| ***F04B 49/06*** | (2006.01) |

(52) U.S. Cl.

CPC ..... *F04D 25/06* (2013.01); *F04B 41/02* (2013.01); *F04B 49/065* (2013.01); *F04B 49/08* (2013.01);

(Continued)

(58) Field of Classification Search

CPC ..... F04B 2201/1201; F04B 2203/0209; F04B 41/02; F04B 49/065; F04B 17/03; F04B 2203/00; F04B 35/04; F04B 49/06; F04B 2205/00; F04B 2207/02; F04B 49/022; F04B 49/08; F04D 25/06; F04D 15/00; F04D 27/00; F04C 14/00; F04C 2270/00; F04C 28/00; F04C 2270/18; F04C 2270/21; H01H 35/24

(Continued)

(56) References Cited

U.S. PATENT DOCUMENTS 7,017,342 B2 3/2006 Iimura et al.
7,476,088 B2 * 1/2009 Iimura ..... F04B 49/08 417/44.2

(Continued)

FOREIGN PATENT DOCUMENTS

CN 1573101 A 2/2005
CN 1594882 A 3/2005

(Continued)

OTHER PUBLICATIONS

China Intellectual Property Office office action for patent application CN201280040412.7 (Dec. 26, 2014).

(Continued)

*Primary Examiner* — Dominick L Plakkoottam
(74) *Attorney, Agent, or Firm* — Kilpatrick Townsend & Stockton LLP

(57) ABSTRACT

An air compressor comprising: a tank (50), a compression mechanism (30), a motor (5) and a control circuit (7). The control circuit (7) includes a CPU (70) and a storing unit (74) which stores a control program, the compressor operation history and a plurality of operation modes. Each of the operation modes is defined by two setting values: a reference restart pressure value and a motor rotational speed value, at (Continued)

least one of these values being different from among the plurality of modes. The control circuit (7) executes one of the plurality of modes as a target mode in which the control unit controls the motor to restart by comparing the pressure in the tank with the reference restart pressure and rotates the motor at the rotational speed of the target mode. The control circuit changes the target mode from the one of the plurality of modes to another one of the plurality of modes based on the compressor operation history.

11 Claims, 10 Drawing Sheets

(52) U.S. Cl.
CPC ..... *F04C 14/00* (2013.01); *F04B 2201/1201* (2013.01); *F04B 2203/00* (2013.01); *F04B 2203/0209* (2013.01); *F04B 2205/00* (2013.01); *F04C 2270/18* (2013.01); *F04C 2270/21* (2013.01)

(58) Field of Classification Search
USPC ..... 417/44.1, 44.2
See application file for complete search history.

(56) References Cited

U.S. PATENT DOCUMENTS

| | | | | |
|---|---|---|---|---|
| 7,641,449 | B2 | 1/2010 | Iimura et al. | |
| 8,784,070 | B2 | 7/2014 | Yokota et al. | |
| 2004/0191073 | A1* | 9/2004 | Iimura | F04B 41/02 417/44.2 |
| 2004/0265134 | A1* | 12/2004 | Iimura | F04B 49/06 417/38 |
| 2007/0059186 | A1* | 3/2007 | Weaver | B25C 1/04 417/234 |
| 2008/0181794 | A1* | 7/2008 | Steinfels | F04B 35/04 417/234 |
| 2009/0194177 | A1* | 8/2009 | Yokota | F04B 35/04 137/565.18 |
| 2011/0206538 | A1* | 8/2011 | Yokota | F04B 41/02 417/1 |

FOREIGN PATENT DOCUMENTS

| | | | |
|---|---|---|---|
| CN | 102177342 | A | 9/2011 |
| DE | 102009052510 | A1 | 5/2011 |
| JP | 60-149223 | A | 8/1985 |
| JP | 4069450 | B | 1/2008 |
| JP | 2010-090824 | A | 4/2010 |
| WO | WO2009010048 | A1 | 1/2009 |

OTHER PUBLICATIONS

Japan Patent Office office action for patent application JP2011-207156 (Apr. 2, 2015).
Japan Patent Office office action for patent application JP2011-207157 (Apr. 2, 2015).
International Search Report for application PCT/JP2012/005405 (Nov. 19, 2012).

* cited by examiner

AIR COMPRESSOR

TECHNICAL FIELD

The present invention relates to an air compressor.

BACKGROUND ART

There is known an air compressor that detects an air pressure in a tank and restarts a motor thereof when the detected air pressure is equal to or lower than a predetermined value. As a more advanced example, Japanese Patent No. 4,069,450 discloses that an air compressor that detects a change rate of air pressure in a tank and controls a motor according to the detected pressure change rate. This air compressor can be made to operate in a silent mode. In the silent mode, when the detected pressure change rate is equal to or lower than a predetermined value, the motor is restarted.

DISCLOSURE OF INVENTION

Solution to Problem

An air compressor is used in various manners depending on user's operation conditions. For example, when nails are driven in a successive manner, air in a tank is rapidly consumed; while when nails are driven at a certain interval, air in a tank is consumed little by little. An absence of consideration of such user's operation conditions poses a problem in that excessive compressed air is supplied to a tank or sufficient compressed air is not supplied to a tank. Although this problem has been improved in the air compressor of Japanese Patent No. 4,069,450 but there is still room for improvement in terms of response to various usages. Further, the air compressor of Japanese Patent No. 4,069,450 has room for improvement in terms of quietness.

It is an object of the present invention to provide an air compressor capable of performing optimum operation in accordance with usage, or an air compressor capable of reducing noise so as not to discomfort those around, increasing continuous use time, and responding to various usages.

In order to attain the above and other objects, the invention provides an air compressor. The air compressor includes a tank, a compression mechanism, a storing unit, and a control circuit. The tank is configured to accommodate compressed air having a pressure. The compression mechanism is configured to supply compressed air to the tank. The motor is configured to drive the compression mechanism. The storing unit stores information indicating a history of an operation state of the air compressor. The control circuit selects one of a plurality of modes, each of the plurality of modes having the rotational speed of the motor and the reference restart pressure. At least one of the rotational speed and the reference restart pressure being different from among the plurality of modes. The control circuit executes one of the plurality of modes as a target mode in which the control unit controls the motor to restart by comparing the reference start pressure corresponding to the target mode with the pressure of the compressed air and rotates the motor at the rotational speed corresponding to the target mode. The control circuit changes the target mode from the one of the plurality of modes to another one of the plurality of modes based on the information.

In an above configuration, the target mode is changed according to the information of the history of the operation state. Accordingly, both the timing to restart the motor and the rotational speed of the motor can be set according to the user's operating condition.

Another aspect of the present invention provides an air compressor. The air compressor includes a tank, a compression mechanism, and a control circuit. The tank is configured to accommodate compressed air having a pressure. The compression mechanism is configured to supply compressed air to the tank. The motor is configured to drive the compression mechanism. a control circuit configured to control the motor to rotate at a rotational speed. The control circuit controls the motor to rotate at the rotational speed slower than or equal to a maximum rotational speed, and stops the motor when the compressed air becomes a maximum pressure value. The control circuit selects one of a first rotational speed and a second rotational speed based on a pressure change rate of the compressed air, and controls the motor to rotate at the selected one of the first rotational speed and the second rotational speed. The first rotational speed is slower than the maximum rotational speed. The second rotational speed is lower than the first rotational speed.

According to an above configuration, continuous use time can be increased while reducing a rotational speed of the motor. Further, the motor rotates at one of the first rotational speed and the second rotational speed based on the pressure change rate. Accordingly, an appropriate rotational speed of the motor can be set, thereby responding to the user's expectations more appropriately.

Advantageous Effects of Invention

The rotational speed and the reference restart pressure can be properly set according to the user's operating condition.

REFERENCE SIGNS LIST

Figure 1A:
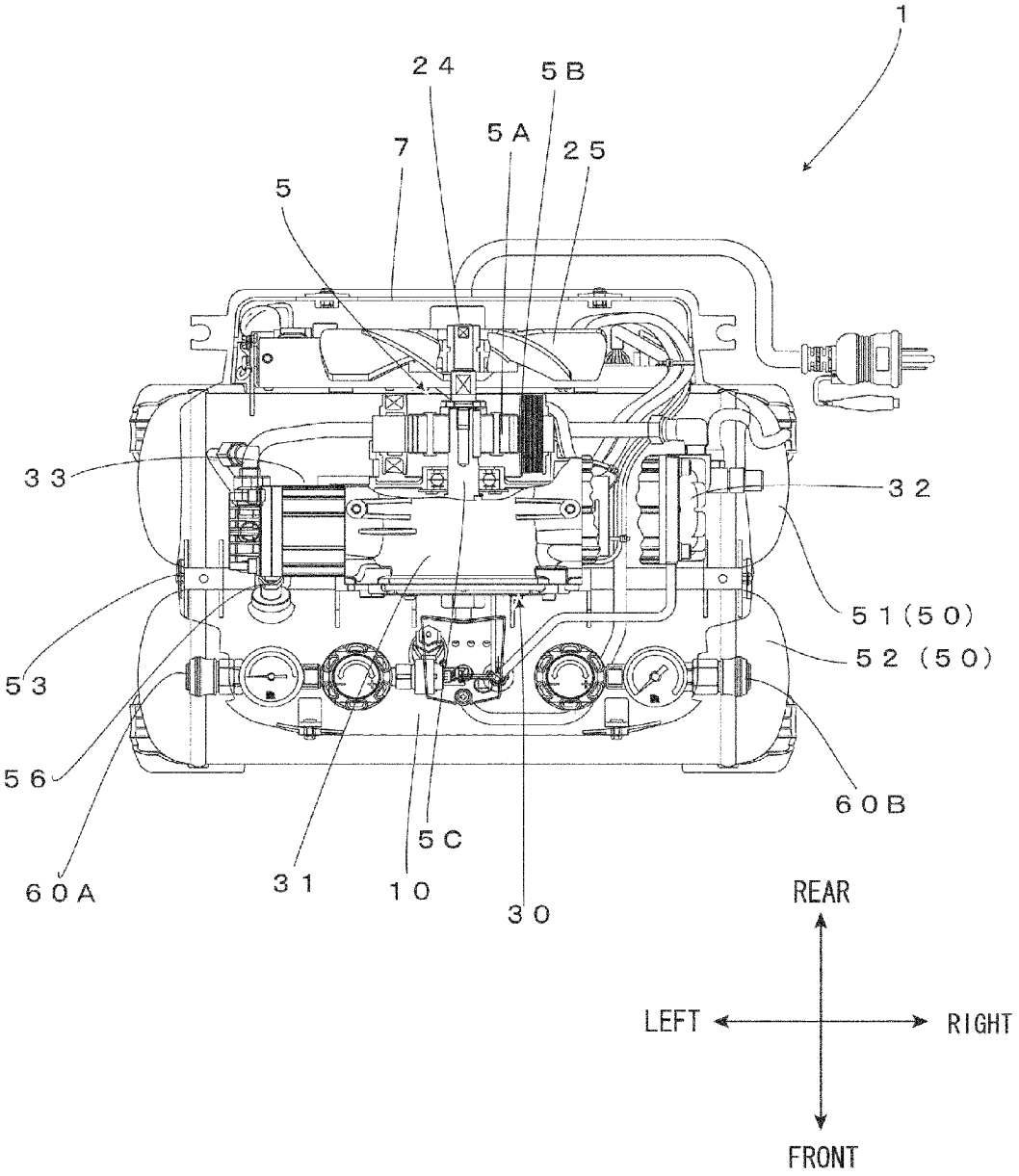
FIG. 1A is a plan view of an air compressor according to an embodiment of a present invention.

1 air compressor
30 compression mechanism
50 tank
5 motor
7 control circuit
70 CPU

DESCRIPTION OF EMBODIMENTS

An air compressor 1 according to an embodiment of the present invention will be described below with reference to the accompanying drawings.

Figure 1B:
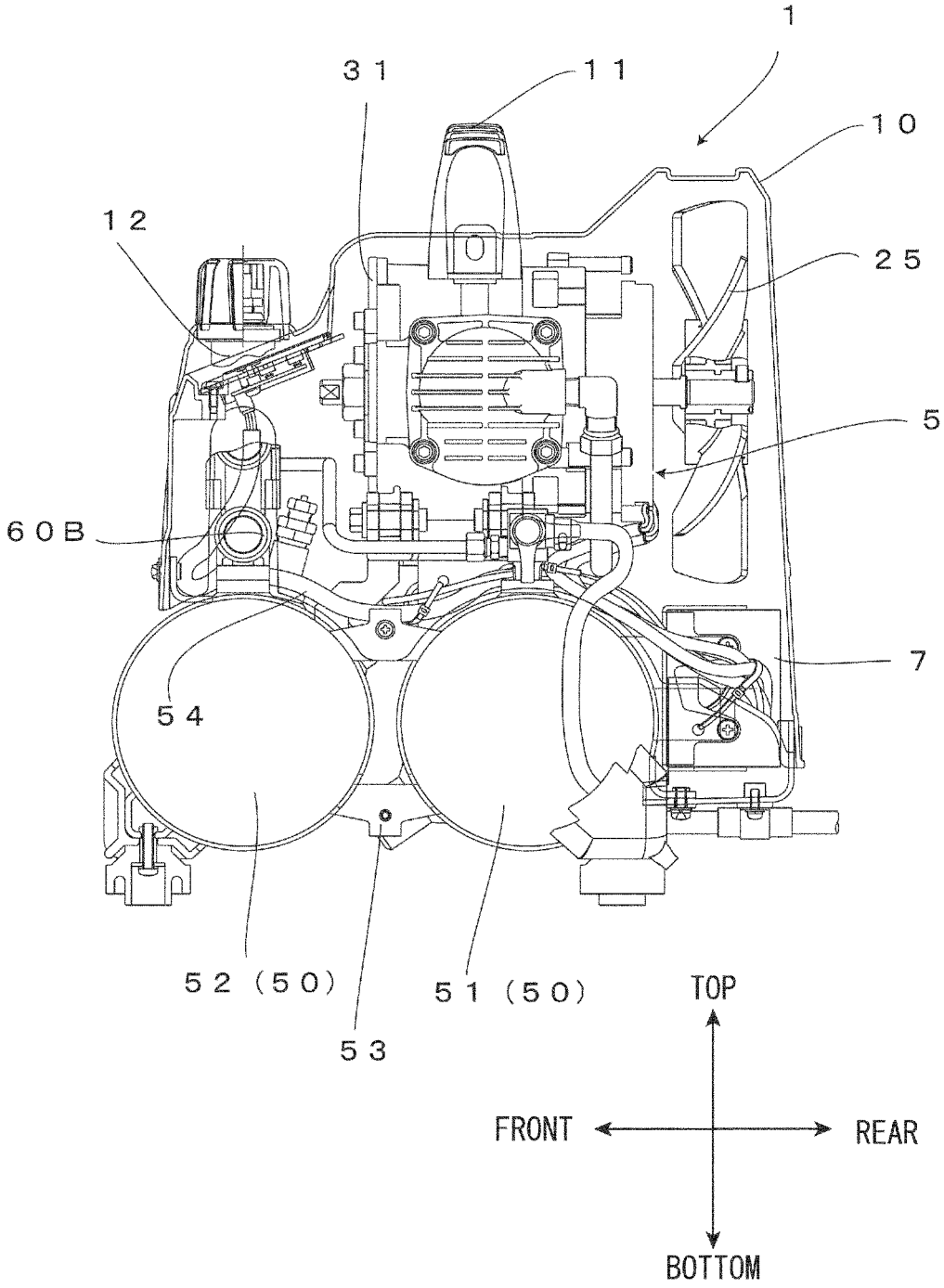
FIG. 1B is a side view of the air compressor.
Figure 1C:
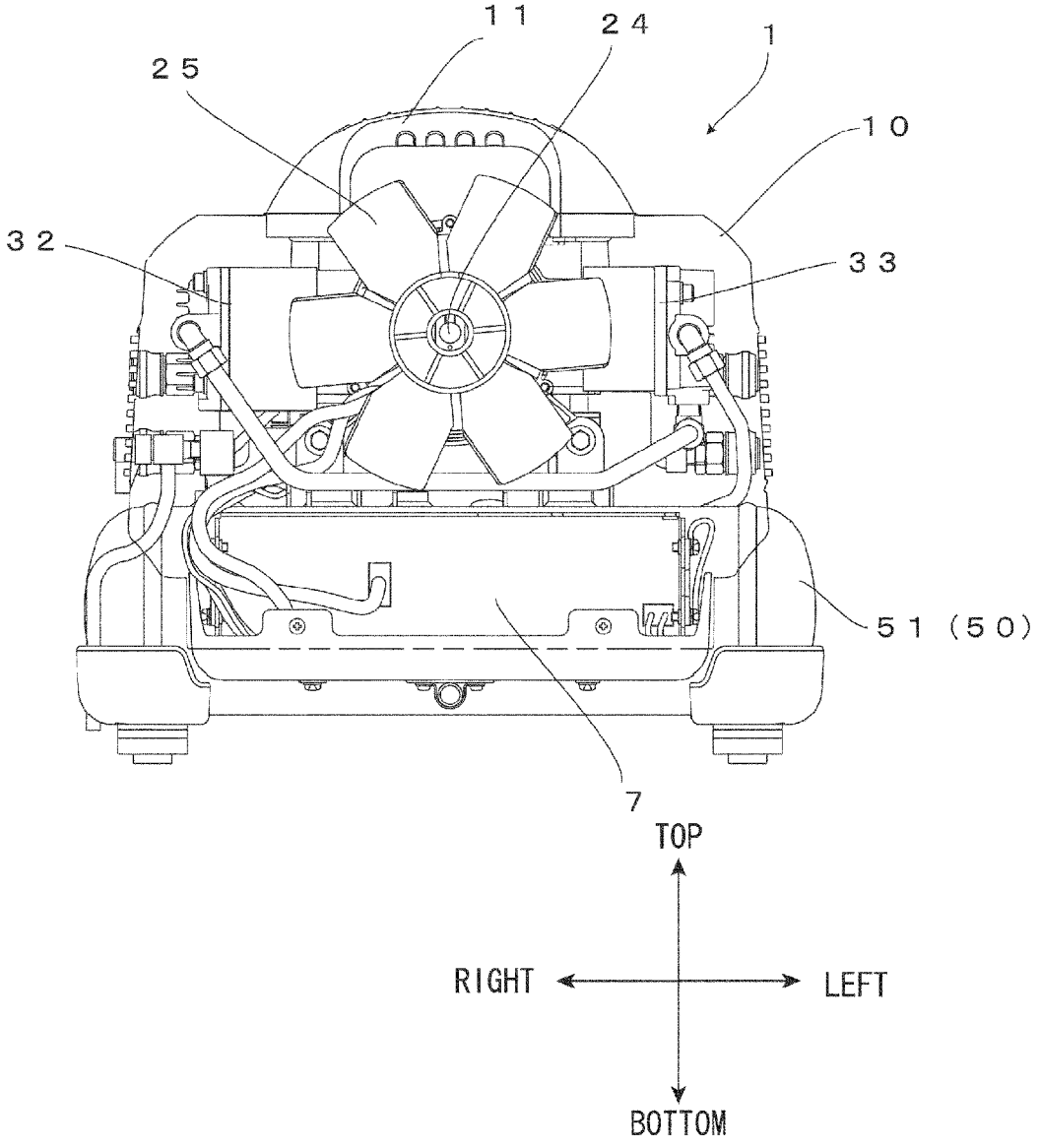
FIG. 1C is a rear view of the air compressor.

The air compressor 1 shown in FIGS. 1A to 1C supplies compressed air to a pneumatic tool such as a nailing machine. The air compressor 1 has a handle 11, a cover 10, a motor 5, a compression mechanism 30, a tank 50 (51, 52), a frame 53, and a control circuit 7.

In the following description, the left side in FIG. 1A is defined as the left side of the air compressor 1, and the right side in FIG. 1A is defined as the right side of the air compressor 1. Further, the upper side in FIG. 1A is defined as the rear side of the air compressor 1, and the lower side in FIG. 1A is defined as the front side of the air compressor 1. Further, the near side in FIG. 1A is defined as the upper side of the air compressor 1, and the back side in FIG. 1A is defined as the lower side of the air compressor 1.

As shown in FIG. 1B, the cover 10 covers the tank 50 (51, 52), the frame 53, and the control circuit 7. An operation panel 12 having a switch 77 (FIG. 2) is provided on an upper surface of the cover 10. The switch 77 is used to switch ON/OFF of a commercial AC power supply to be supplied to the air compressor 1 through a supply cord. The switching operation by the switch 77 switches ON/OFF of supply of drive power to the control circuit 7 and the motor 5. The operation panel 12 can display a pressure value in the tank 50 (51, 52) and an alarm indicating an overload state.

The tanks 51 and 52 each have substantially a cylindrical shape having an axis extending in the left-right direction and is closed both end portions. The tanks 51 and 52 extend in parallel in the left-right direction. The both end portions of the tank 51 are aligned with those of the tank 52, respectively. The tanks 51 and 52 are fixed by the frame 53. An inside of the tank 51 and that of the tank 52 communicate with each other through a communication pipe (not shown).

The motor 5 and the compression mechanism 30 are disposed at a center of the tank 51 in the axial direction thereof. The motor 5 is a brushless motor controlled by three-phase AC and has a rotor 5A, a stator 5B, and an output shaft 5C rotating in conjunction with the rotor 5A. The output shaft 5C extends in a direction perpendicular to the axial direction of the tank 51, i.e., in the front-rear direction. A part of the output shaft 5C on the front side penetrates a crank case 31 to be described later.

An axial flow fan 25 and a fan rotary shaft 24 are provided at an rear portion of the output shaft 5C. The axial flow fan 25 is coaxially fixed to the fan rotary shaft 24 so as to be rotatable in conjunction therewith. The fan rotary shaft 24 is coaxially fixed to the output shaft 5C. Rotation of the axial flow fan 25 causes outside air to be introduced inside the cover 10, which in turn causes air to flow from the rear side of the motor 5 to the front side thereof, thereby cooling the motor 5.

The compression mechanism 30 is provided at the front side relative to the motor 5 and is connected to the motor 5. The compression mechanism 30 has a crank case 31, a first compressor 32, and a second compressor 33. A crank shaft (not shown) is disposed inside the crank case 31. The first compressor 32 and the second compressor 33 each have a cylinder (not shown), a piston (not shown) and a cylinder head (not shown). The crank shaft (not shown) is configured to rotate in conjunction with the output shaft 5C of the motor 5 and is drive-connected to the piston (not shown). The rotation of the motor 5 is converted through the crank shaft into reciprocating motion of the piston disposed inside each cylinder. The first compressor 32 is connected to the second compressor 33 so as to allow transfer of compressed air. The second compressor 33 is connected to the tank 52.

Air flowing in from a through hole (not shown) formed in the cover 10 is compressed to a pressure of 0.7 MPa to 0.8 MPa in the cylinder (not shown) of the first compressor 32 by the reciprocating motion of the piston (not shown) in the cylinder (not shown) of the first compressor 32. The air compressed in the first compressor 32 flows in the cylinder (not shown) of the second compressor 33 and compressed to a permissible maximum pressure of 3.0 MPa to 4.35 MPa. The air compressed in the second compressor 33 passes through a pipe member 56 and flows in the tank 52. The compressed air that has flowed in the tank 52 partly flows in the tank 51 through a communication pipe 54 (FIG. 1B). In this manner, the compressed air is stored in the tanks 51 and 52 at the same pressure.

Compressed air outlets (couplers) 60A and 60B are provided above both end portions of the tank 5, respectively. Each of the couplers 60A and 60B can be connected with a pneumatic tool such as a nailing machine and can supply compressed air to the connected pneumatic tool.

Figure 2:
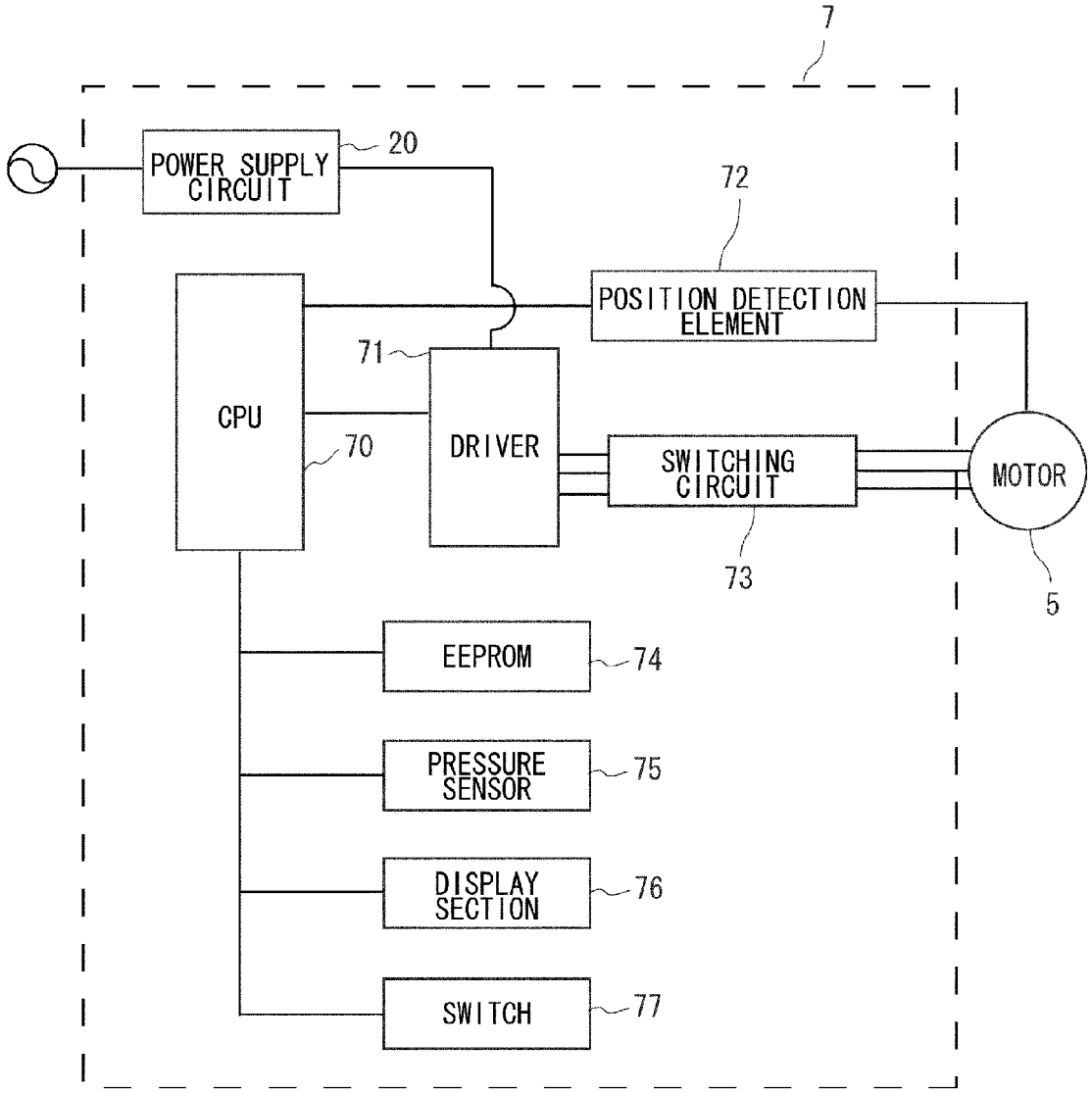
FIG. 2 is a block diagram illustrating an electrical structure of the air compressor.

As shown in FIG. 2, in the air compressor 1, a power supply circuit 20, the control circuit 7, and the motor 5 are electrically connected. The control circuit 7 includes a CPU 70, a driver 71, a position detection element 72, a switching circuit 73, an EEPROM 74, a pressure sensor 75, a display section 76, and a switch 77.

The motor 5 according to the present embodiment is a three-phase DC brushless motor and has the rotor 5A having a permanent magnet including a plurality of sets of N and S poles and the stator 5B including three-phase stator conductors U, V, W which are connected in a star connection. Sequential switching of the stator conductors in which current flows cause the motor 5 (rotor 5A) to rotate.

A plurality of rotor position detection elements 72 is provided at positions opposed to the permanent magnet of the rotor 5A at a predetermined interval (e.g., a 90-degree interval) in a circumferential direction of the rotor 5A and outputs a signal corresponding to a rotational position of the rotor 5A.

The CPU 70 detects the rotational position of the rotor 5A based on the signal from the rotor position detection elements 72. The CPU 70 further calculates a rotational speed of the rotor 5A (hereinafter, also referred to as "rotational speed of the motor 5") from a change in the rotational position of the rotor 5A. The CPU 70 transfers the rotational position and rotational speed of the rotor 5A to the driver 71.

The switching circuit 73 supplies current to the conductors corresponding to the U, V, and W phases of the motor 5. The driver 71 controls the switching circuit 73 based on the rotational position of the rotor 5A to supply current to the conductors corresponding to the U, V, and W phases at the right time.

The EEPROM 74 is a non-volatile memory and stores a control program that executes control processing to be described later. The EEPROM 74 further stores various setting values required for execution of the control program, such as a filling flag, a pressure flag, a 4 MPa flag, and a sub-mode value.

The pressure sensor 75 measures a pressure of air in the tank 50 (hereinafter, referred to merely as "pressure") and transfers the measured pressure value to the CPU 70.

The display section 78 includes an LED light for notification of an operation status of the air compressor.

The switch 77 is provided in the operation panel 12 (FIG. 1B) and is used for a user to switch ON/OFF of a power supply and to switch operation modes between a normal mode, a learning mode, and a silent mode. The switch 77 is set to one of the normal mode, the learning mode, and the silent mode before operation of the air compressor 1.

In the normal mode, when the pressure becomes lower than 4.0 MPa, the motor 5 is restarted and controlled so as to rotate at 2,800 rpm.

Although details will be described later, in the learning mode, a sub-mode is set to one of A, B, and C, and the set sub-mode is switched according to a status of use of the air compressor 1. The sub-mode value is set to one of A, B, and C, which indicates that one of the sub-modes A, B, and C is set as the sub-mode. In the sub-modes A and B, the motor 5 is controlled so as to rotate at 2,800 rpm. In the sub-mode C, the motor 5 is controlled so as to rotate at 2,800 rpm only for the first time after power-on and at 2,000 rpm for the second or subsequent time.

In the sub-mode A, when the pressure becomes lower than 4.0 MPa, the motor 5 is restarted. In the sub-mode B, when the pressure is higher than 3.2 MPa and lower than 4.0 MPa, the motor 5 is restarted under the condition that a pressure change rate (pressure change/time) is lower than −0.05 MPa/sec. Alternatively, in the sub-mode B, when the pressure becomes equal to or lower than 3.2 MPa, the motor 5 is restarted regardless of the pressure change rate. In the sub-mode C, when the pressure becomes lower than 2.3 MPa, the motor 5 is restarted.

That is, at least one of the rotational speed of the motor 5 and pressure at which the motor 5 is restarted is different among the sub-modes A, B, and C.

When the power is switched ON by the operation of the switch 77, drive current for control circuit is supplied from the power supply circuit 20 to the control circuit 7 and the motor 5.

Figure 3:
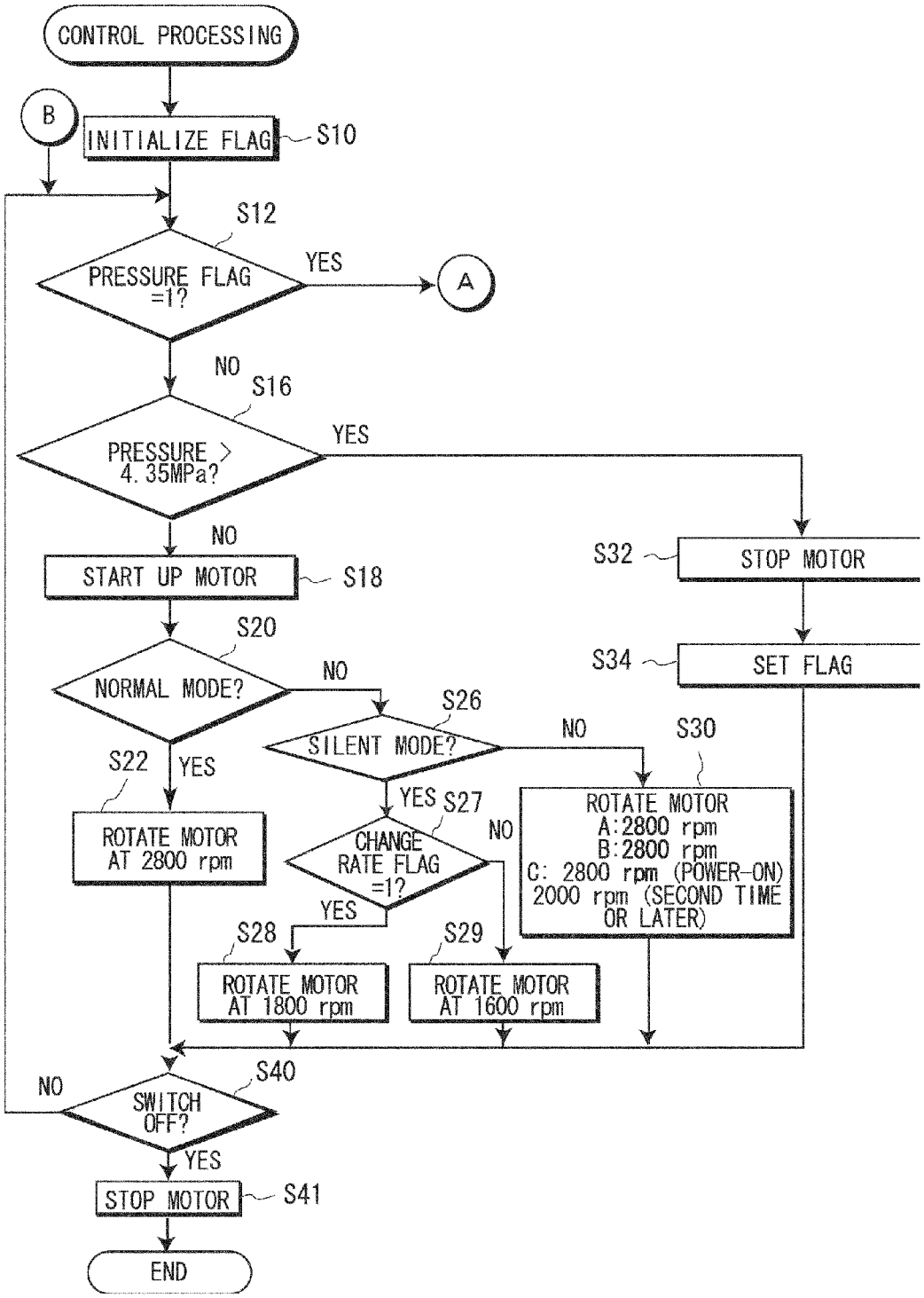
FIG. 3 is a flowchart of a control processing executed by the air compressor according to the present embodiment.

FIG. 3 is a flowchart of the control program according to the present embodiment. The control processing starts when the power is switched ON by the operation of the switch 77.

In S10, the CPU 70 sets 0 as initial values of the filling flag, the pressure flag, and a pressure change rate flag. The CPU 70 sets B as an initial value of the sub-mode value. The filling flag indicates whether or not the tank 50 has been fully filled with air after the start of the processing, i.e., after the power ON. That is, the filling flag is set to 0 as an initial value. When the pressure of air in the tank 50 is higher than 4.35 MPa (when the tank 50 is in a fully-filled state), the filling flag is set to 1. The pressure flag indicates whether or not the pressure of air in the tank 50 is higher than 4.0 MPa. When the pressure of air in the tank 50 is equal to or higher than 4.0 MPa, the pressure flag is set to 1, and when the pressure of air in the tank 50 is lower than 4.0 MPa, the pressure flag is set to 0. The pressure change rate flag indicates whether or not the pressure change rate of air in the tank 50 is equal to or lower than −0.05/3 (MPa/sec). That is, when the pressure change rate is equal to or lower than −0.05/3 (MPa/sec), the pressure change rate flag is set to 1, and otherwise set to 0. The 4.0 MPa flag indicates that an air consumption amount is large in a time period where the pressure of air in the tank 50 is higher than 4.0 MPa after the tank 50 has reached its fully-filled state, that is, in a time period immediately after start of consumption of compressed air.

In S12, the CPU 70 determines whether or not the pressure flag is 1. In S12, the pressure flag is used to determine whether to allow start-up of the motor 5. That is, when the pressure flag is 0, the start-up of the motor 5 is allowed, and when the pressure flag is 1, the start-up of the motor 5 is prohibited. With this control, the motor can be prevented from being started-up in a state where a large load is applied on the motor to thereby prevent overcurrent.

In S16, the CPU 70 determines, based on the pressure value measured by the pressure sensor 75, whether or not the pressure of air in the tank 50 is higher than 4.35 MPa. When the pressure is equal to or lower than 4.35 MPa (NO in S16), the CPU 70 starts-up the motor 5 in S18. In S20, the CPU 70 determines whether or not the switch 77 has been set to the normal mode. When the switch 77 has been set to the normal mode (YES in S20), the CPU 70 causes the motor 5 to rotate at 2,800 rpm corresponding to the normal mode in S22 to supply compressed air to the tank 5.

When the switch 77 has not been set to the normal mode, the CPU 70 determines in S26 whether or not the switch 77 has been set to the silent mode. When the switch 77 has been set to the silent mode (YES in S26), the CPU 70 determines in S27 whether or not the pressure change rate flag is 1. When the pressure change rate flag is 1 (YES in S27), the CPU 70 causes the motor 5 to rotate at 1,800 rpm in S28 to supply compressed air to the tank 5. When the pressure change rate flag is 0 (NO in S27), the CPU 70 causes the motor 5 to rotate at 1,600 rpm in S29 to supply compressed air to the tank 5.

When the switch 77 has not been set to the silent mode (NO in S26), that is, when the switch 77 is set to the learning mode, the CPU 70 causes the motor to rotate at the following rotational speed according to the sub-mode value to supply compressed air to the tank 5. That is, in a case where the sub-mode value is one of A and B, the rotational speed is set to 2,800 rpm. In a case where the sub-mode value is C, when S30 is executed for the first time after power-on, that is, when the filling flag is set to 0, the rotational speed is set to 2,800 rpm. In a case where the sub-mode value is C, when S30 is executed at second or subsequent time, that is, when the filling flag is set to 1, the rotational speed is set to 2,000 rpm.

On the other hand, when the pressure is higher than 4.35 MPa (YES in S16), the CPU 70 stops the motor 5 in S32. With this processing, the CPU 70 controls the motor 5 such that the maximum pressure of air in the tank 50 becomes 4.35 MPa. Thereafter, the CPU 70 sets both the filling flag and pressure flag to 1 in S34.

When any one of S22, S28, S29, S30, and S34 is ended, the CPU 70 determines in S40 whether or not the switch 77 has been turned OFF. When the switch 77 is still in an ON state, (NO in S40), the CPU 70 returns to S12. When the switch is in an OFF state (YES in S40), the CPU 70 stops the motor in S41 to end this routine.

Figure 4:
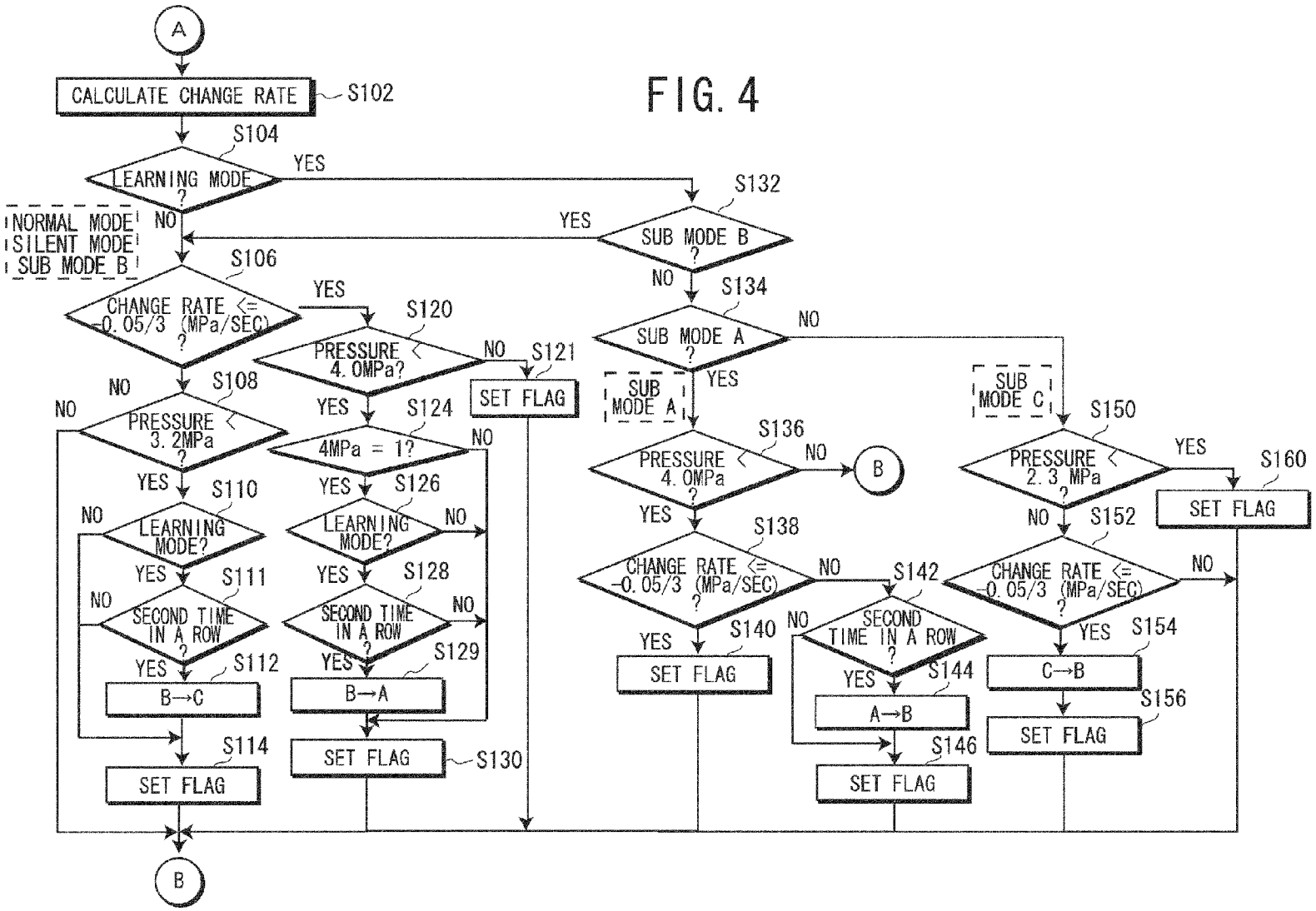
FIG. 4 is a flowchart of processing executed during the control processing shown in FIG. 3.

Next, a processing flow shown in FIG. 4 will be described. In S102, the CPU 70 calculates the pressure change rate. More specifically, the CPU 70 calculates the pressure change rate from pressure values that the pressure sensor 75 has measured at a predetermined time interval (every 3 seconds in the present embodiment). The pressure change rate is calculated by dividing the pressure change by the predetermined time interval. The calculated pressure change rate is stored in the EEPROM 74. In S104, the CPU 70 determines whether or not the switch 77 has been set to the learning mode. When the switch 77 has been set to the learning mode (YES in S104), the CPU 70 determines in S132 whether or not the sub-mode value is B. When the sub-mode value is B (YES in S132) or when the switch 77 has not been set to the learning mode (NO in S104), the CPU 70 determines in S106 whether or not the pressure change rate is equal to or lower than −0.05/3 (MPa/sec). As is clear from the above, processing of S106 and subsequent steps are executed when the operation mode is one of the normal mode, the silent mode, and the learning mode in which the sub-mode value is set to B.

When the pressure change rate is higher than −0.05/3 (MPa/sec), that is, a pressure decrease rate is not higher (NO in S106), the CPU 70 determines in S108 whether or not the pressure is lower than 3.2 MPa. When the pressure is equal to or higher than 3.2 MPa (NO in S108), the CPU 70 returns to S12 of FIG. 3. When the pressure is lower than 3.2 MPa (YES in S108), the CPU 70 determines in S110 whether or not the switch 77 has been set to the learning mode. When the switch 77 has been set to the learning mode (YES in S110), the CPU 70 determines in S111 whether or not the pressure change rate has been determined to be higher than −0.05/3 (MPa/sec) in S106 for the second time in a row. More specifically, when the pressure change rate flag has already been set to 0, the CPU 70 determines that the pressure change rate has been determined to be higher than −0.05/3 (MPa/sec) for the second time in a row. Alternatively, the CPU 70 may store a value of the pressure change rate in the EEPROM 74 as a history every time the CPU 70 calculates the value and make the determination by referring to the history. When an affirmative determination is made in S111 (YES in S111), the CPU 70 sets the sub-mode value to C in S112. When the CPU 70 determines that the pressure change rate has been determined to be higher than −0.05/3 (MPa/sec) for the second time in a row, a user is expected to be, for example, driving nails at a considerable time interval and thus air in the tank 50 will be consumed slowly for a while. Thus, the CPU 70 changes the sub-mode value from B to C. In the sub-mode C, the motor 5 is started-up only when the pressure becomes equal to or lower than 2.3 MPa, which prevents the motor 5 from being started-up unnecessarily.

When the switch 77 has not been set to the learning mode (NO in S110), when the pressure change rate has not been determined to be higher than −0.05/3 (MPa/sec) for the second time in a row (NO in S111), or after execution of the processing of S112, in S114 the CPU 70 sets values of both the pressure flag and the pressure change rate flag to 0, and returns to S12 of FIG. 3.

When the pressure change rate is equal to or lower than −0.05/3 (MPa/sec) (YES in S106), in S120 the CPU 70 determines whether or not the pressure is lower than 4.0 MPa. When the pressure is equal to or higher than 4.0 MPa (NO in S120), in S121 the CPU 70 sets a value of the 4 MPa flag to 1, and returns to S12 of FIG. 3.

When the pressure is lower than 4.0 MPa (YES in S120), the CPU 70 determines in S124 whether or not the value of the 4 MPa flag is 1. The value 1 of the 4.0 MPa flag indicates that the air consumption amount has already become large before the pressure of air in the tank 50 is reduced to 4.0 MPa, that is, immediately after start of user's operation. When the value of the 4 MPa flag is 1 (YES in S124), the CPU 70 determines in S126 whether or not the switch 77 has been set to the learning mode and then determines in S128 whether or not the motor has been restarted for the second time in a row in a state where the value of the 4.0 MPa flag is 1. More specifically, for example, the CPU 70 may store information that the motor is restarted through S128 in the EEPROM 74 as a history and make the determination by referring to the history. When an affirmative determination is made in S128, the CPU 70 sets the sub-mode value to A in S129. When the CPU 70 determines that motor has been restarted for the second time in a row in a state where the value of the 4.0 MPa flag is 1, the user is expected to be, for example, driving nails in a successive manner and thus air in the tank 50 will be consumed significantly. Thus, the CPU 70 changes the sub-mode value from B to A. In the sub-mode A, the motor 5 is restarted immediately when the pressure is lower than 4.0 MPa and rotates at a maximum rotational speed of 2,800 rpm, thereby providing an early supply of air in the tank 50. This increases the continuous use time of the air compressor 1.

When a negative determination is made in any one of S124, S126, and S128 or after execution of the processing of S129, in S130 the CPU 70 sets the values of the pressure flag and the pressure change rate flag to 0 and 1, respectively, and returns to S12 of FIG. 3.

When the sub-mode value is not B (NO in S132), the CPU 70 determines in S134 whether or not the submode value is A. When the sub-mode value is A (YES in S134), the CPU 70 determines in S136 whether or not the pressure is lower than 4.0 MPa. When the pressure is equal to or higher than 4.0 MPa (NO in S136), the CPU 70 returns to S12 of FIG. 3.

When the pressure is lower than 4.0 MPa (YES in S136), the CPU 70 determines in S138 whether or not the pressure change rate is equal to or lower than −0.05/3 (MPa/sec). When the pressure change rate is equal to or lower than −0.05/3 (MPa/sec) (YES in S138), in S140 the CPU 70 sets the values of the pressure flag and the pressure change rate flag to 0 and 1, respectively, and returns to S12 of FIG. 3.

When the pressure change rate is higher than −0.05/3 (MPa/sec) (NO in S138), the CPU 70 determines in S142 whether or not the pressure change rate has been determined to be higher than −0.05/3 (MPa/sec) for the second time in a row. More specifically, when the value of the pressure change rate flag has already been set to 0, the CPU 70 determines that the pressure change rate has been determined to be higher than −0.05/3 (MPa/sec) for the second time in a row. Alternatively, the CPU 70 may store a value of the pressure change rate in the EEPROM 74 as a history every time the CPU 70 calculates the value and make the determination by referring to the history. When the pressure change rate has been determined to be higher than −0.05/3 (MPa/sec) for the second time in a row (YES in S142), the CPU 70 sets the sub-mode value to B in S144.

When the CPU 70 determines that the pressure change rate has been determined to be higher than −0.05/3 (MPa/sec) for the second time in a row, the user is expected to be, for example, driving nails at time intervals and thus air in the tank 50 is expected to be not consumed significantly for a while. Thus, the CPU 70 changes the sub-mode value from A to B. In the sub-mode B, the motor 5 is started-up when the pressure change rate is equal to or lower than −0.05/3 (MPa/sec) under the condition that the pressure is higher than 3.2 MPa and lower than 4.0 MPa, or when the pressure is lower than 3.2 MPa and rotates at a maximum rotational speed of 2,800 rpm. Thus, air supply timing can be set appropriately based on the pressure and pressure change rate.

When the pressure change rate has been determined to be higher than −0.05/3 (MPa/sec) for the first time (NO in S142), or after execution of the processing of S144, in S146 the CPU 70 sets the values of both the pressure flag and the pressure change rate flag to 0.

When the sub-mode value is not A (NO in S134), that is, when the sub-mode value is C, the CPU 70 determines in S150 whether or not the pressure is lower than 2.3 MPa. When the pressure is lower than 2.3 MPa, in S160 the CPU 70 sets the values of both the pressure flag and the pressure change rate flag to 0, and returns to S12 of FIG. 3.

When the pressure is equal to or higher than 2.3 MPa (NO in S150), the CPU 70 determines in S152 whether or not the pressure change rate is equal to or lower than −0.05/3 (MPa/sec). When the pressure change rate is equal to or lower than −0.05/3 (MPa/sec) (YES in S152), in S154 the CPU 70 sets the sub-mode value to B. Subsequently, in S156 the CPU 70 sets the values of the pressure flag and the pressure change rate flag to 0 and 1, respectively, and returns to S12 of FIG. 3.

When the pressure change rate is higher than −0.05/3 (MPa/sec) (NO in S152), the CPU 70 returns to S12.

Figure 5:
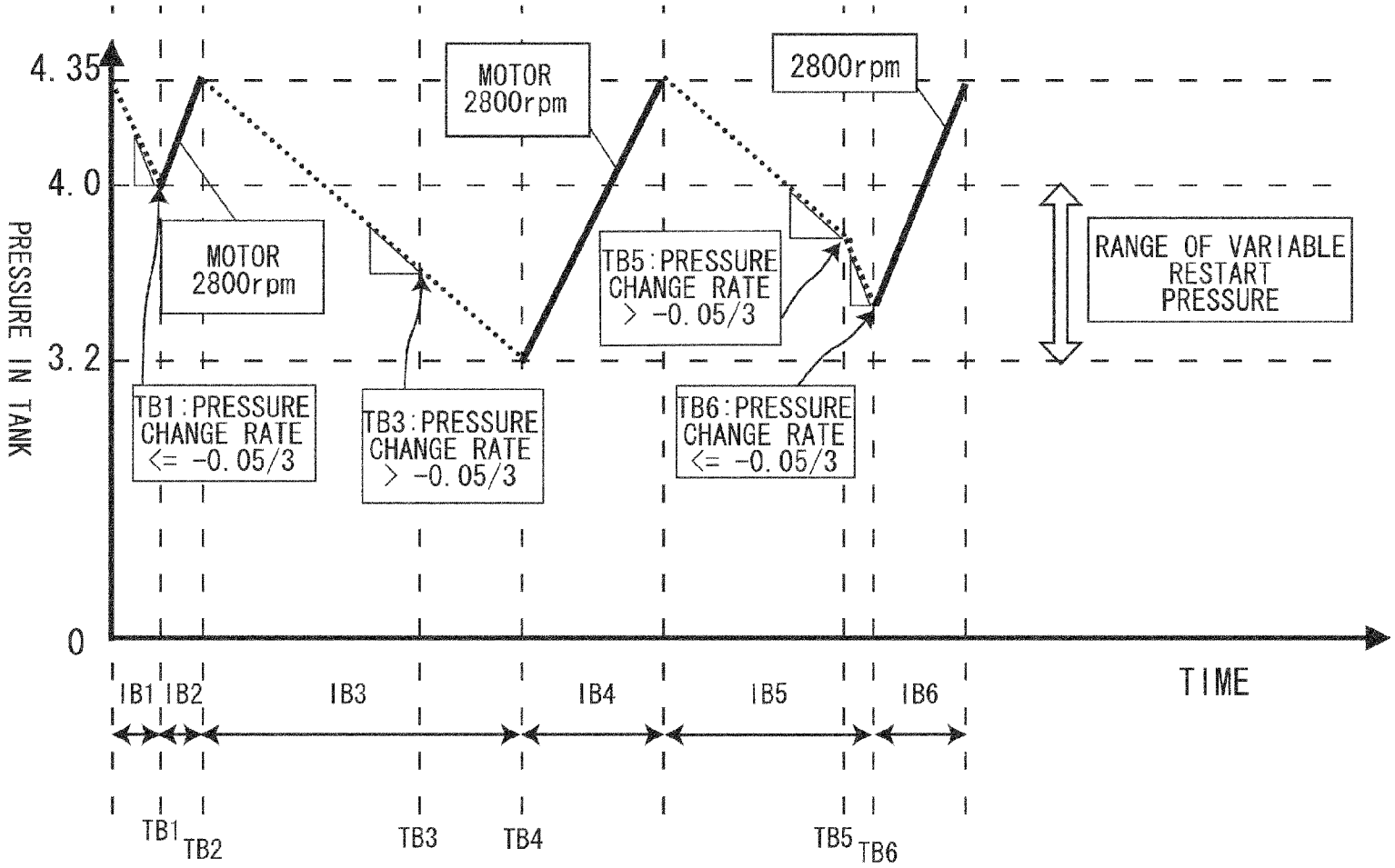
FIG. 5 is a timing chart illustrating processing performed in a sub-modes B.
Figure 6:
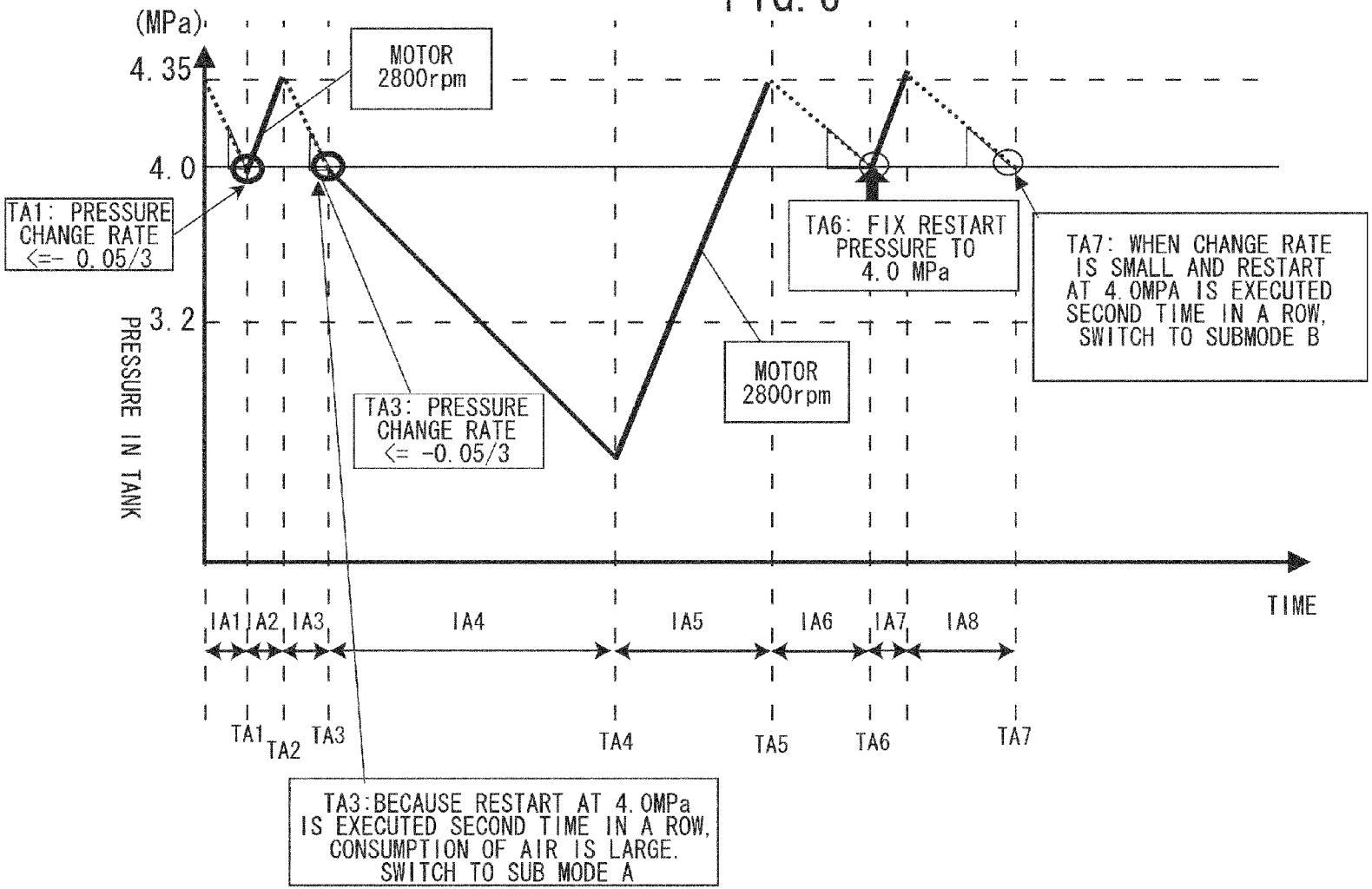
FIG. 6 is a timing chart illustrating processing performed in a sub-modes A.
Figure 7:
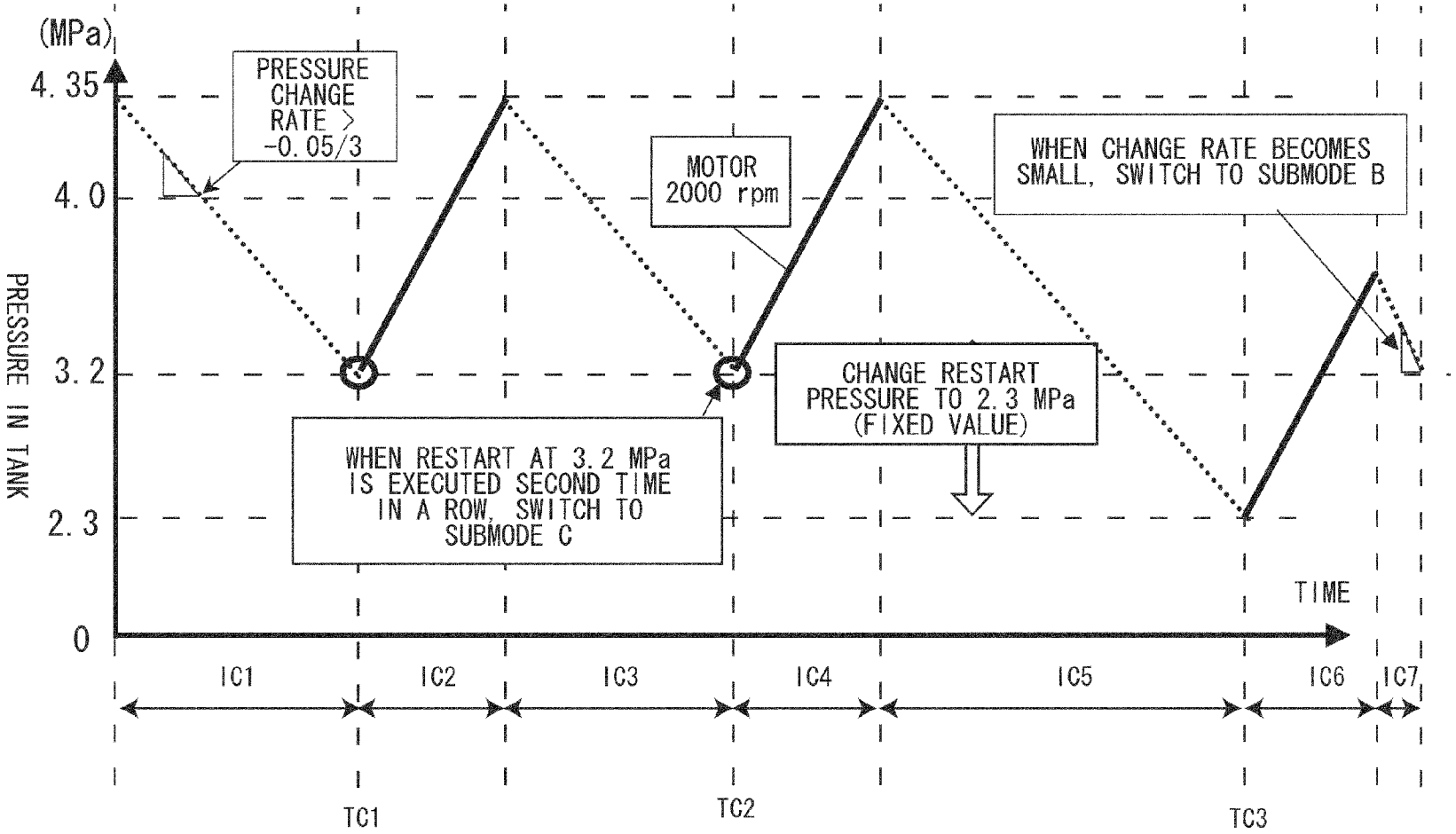
FIG. 7 is a timing chart illustrating processing performed in a sub-modes C.

The following describes processing to be performed in each sub-mode of the learning mode based on the control processing described above. FIGS. 5 to 7 are timing charts illustrating processing to be performed in the sub-modes B, A, and C, respectively. In FIGS. 5 to 7, a horizontal axis represents a time, and a vertical axis represents a pressure (MPa). As described above, the sub-mode B is a sub-mode that is set at the beginning of the control processing, and sub-modes A and C are sub-modes which are necessarily switched from the sub-mode B. Thus, in FIGS. 5 to 7, the sub-mode has been set to B at time 0. Note that time 0 represents a state where the tank 50 is filled with air and the motor 5 is stopped (S32).

As shown in FIG. 5, in an interval IB1, compressed air is consumed and thus a pressure in the tank is reduced. At a time TB1, the CPU 70 executes S106 to determine that the pressure change rate is lower than −0.05/3 (MPa/sec) (YES in S106), that is, the air consumption amount per unit time is large and further determines that the pressure is lower than 4.0 MPa (YES in S120). In this case, the CPU 70 does not switch the sub-mode to A (S129 is skipped) and sets the values of the pressure flag and the pressure change rate flag to 0 and 1, respectively, while keeping the sub-mode B (S130). Since the value of the pressure flag is 0, a negative determination is made in S12, and the motor rotates at 2,800 rpm in an interval IB2 to supply air to the tank 50 (S30). At a time TB2, the CPU 70 determines that the pressure is higher than 4.35 MPa (YES in S16), stops the motor (S32), and thereafter sets the value of the pressure flag to 1 (S34).

In an interval IB3, the use of air compressor 1 by the user decreases the amount of air in the tank 50. However, the sub-mode is B, the pressure change rate is higher than −0.05/3 (MPa/sec) (time TB3, NO in S106), that is, the air consumption amount per unit time is small, and the pressure is equal to or higher than 3.2 MPa (NO in S108), so that the motor 5 is not restarted.

At a time TB4, the CPU 70 determines that the pressure is lower than 3.2 MPa (YES in S108) and sets the values of both the pressure flag and the pressure change rate flag to 0 to cause the motor 5 to rotate at 2,800 rpm (S30). In an interval IB4, air is supplied to the tank 50, and thereafter, the motor 5 is stopped (S32).

In an interval IB5, at a time TB5, the pressure change rate is not equal to or lower than −0.05/3 (MPa/sec) (NO in S106), and the pressure is higher than 3.2 MPa (NO in S108), so that the value of the pressure flag is kept at 1, and thus the motor 5 is not restarted. However, at a time TB6, the pressure change rate becomes equal to or lower than −0.05/3 (MPa/sec) (YES in S106), and the CPU 70 sets the value of the pressure flag to 0 in S130. The CPU 70 causes the motor 5 to rotate at 2,800 rpm (S30) and thereafter stops the motor 5 (S32).

As described above, in the sub-mode B, when the pressure change rate becomes equal to or lower than −0.05/3 (MPa/sec) under the condition that the pressure of air in the tank 50 is lower than 4.0 MPa and higher than 3.2 MPa, the CPU 70 restarts the motor 5 and causes the motor 5 to rotate at 2,800 rpm. When the pressure is lower than 3.2 MPa, the CPU 70 restarts the motor 5 and causes the motor 5 to rotate at 2,800 rpm regardless of the pressure change rate (even if the pressure change rate is higher than −0.05/3 (MPa/sec)). As described above, a restart timing of the motor 5 is determined based on the pressure of air in the tank 50 and pressure change rate, which allows air to be supplied at the right time, thereby increasing the continuous use time of the air compressor 1.

The following describes the sub-mode A with reference to FIG. 6. In an interval IA1, the sub-mode has been set to B. In the interval IA1, the pressure change rate is equal to or lower than −0.05/3 (MPa/sec) (YES in S106), and the pressure is lower than 4.0 MPa (YES in S120). However, the motor 5 is not restarted in a state where the value of the 4.0 MPa flag has been determined to be 1 for the second time in a row (NO in S128), so that the CPU 70 does not switch the sub-mode to A (S129 is skipped). In S130, the CPU 70 sets the values of the pressure flag and the pressure change rate flag to 0 and 1, respectively. Since the value of the pressure flag is 0, a negative determination is made in S12. Accordingly, the CPU 70 restarts the motor 5 at a time TA1 (S18), causes the motor 5 to rotate at 2,800 rpm based on the setting of the sub-mode B in an interval IA2 (S30), and thereafter stops the motor 5 (S32).

In an interval IA3, the pressure change rate is equal to or lower than −0.05/3 (MPa/sec) (YES in S106), and the pressure is equal to or lower than 4.0 MPa at a time TA3 (YES in S120), so that the CPU 70 sets the values of the pressure flag and the pressure change rate flag to 0 and 1, respectively (S130). Here, the motor is restarted in a state where the value of the 4.0 MPa flag has been determined to be 1 for the second time in a row (YES in S128), so that the CPU 70 sets the sub-mode to A (S129). Since the value of the pressure flag is 0, a negative determination is made in S12. Accordingly, the CPU 70 restarts the motor 5 at the time TA3 (S18) and causes the motor 5 to rotate at 2,800 rpm based on the setting of the sub-mode A (S30).

In an interval IA4, the air consumption amount exceeds an air supply amount although the motor 5 rotates at 2,800 rpm, so that the amount of air in the tank 50 gradually decreases. At a time TA4, the use of air is disrupted. In an interval IA5, the motor 5 rotates at 2,800 rpm, and the pressure of air in the tank 50 reaches 4.35 MPa at a time TA5, the motor 5 is stopped (S32). As a result, the CPU 70 sets the value of the pressure flag to 1 (S34). At a time TA6 in an interval IA6, the pressure becomes lower than 4.0 MPa (YES in S136). In an interval IA6, the pressure change rate is higher than −0.05/3 (MPa/sec) (NO in S138), the value of the pressure flag is set to 0 in S146. As a result, in an interval IA7, the CPU 70 restarts the motor 5 (S18) and causes the motor 5 to rotate at 2,800 rpm (S30). Note that the CPU 70 does not determine here that the pressure change rate is higher than −0.05/3 (MPa/sec) for the second time in a row (NO in S142), so that S144 is skipped, and the sub-mode is kept at A.

In an interval IA8, air is consumed at the same rate as in an interval IA6, so that the pressure flag is set to 0 (S146) at a time TA7 as in the case of time TA6. However, the CPU 70 determines here that the value of the pressure change rate is higher than −0.05/3 (MPa/sec) for the second time in a row (YES in S142), the sub-mode is switched to B (S144).

In a case where the motor is restarted in a state where the 4.0 MPa flag has been determined to be 1 for the second time in a row, the user is expected to be engaged, for a while, in an operation in which a considerable air amount is consumed. Thus, the CPU 70 switches the sub-mode from B to A and, when the pressure becomes lower than 4.0 MPa, causes the motor 5 to rotate at 2,800 rpm. Thus, the motor 5 is immediately restarted to supply air in a state where the air consumption amount is large, thereby increasing the continuous use time of the air compressor 1.

The following describes the sub-mode C with reference to FIG. 7. In an interval IC1, the sub-mode has been set to B. In the interval IC1, the pressure change rate is higher than −0.05/3 (MPa/sec) (NO in S106), so that the motor 5 is not restarted until the pressure becomes lower than 3.2 MPa at a time TC1. At the time TC1, the CPU 70 determines that the pressure is lower than 3.2 MPa (YES in S108) and sets the value of the pressure flag to 0 (S114). The CPU 70 does not determine here that the pressure change rate is higher than −0.05/3 (MPa/sec) for the second time in a row (NO in S111), so that the sub-mode is kept at B. Thus, in an interval IC2, the CPU 70 restarts the motor 5 (S18) causes the motor 5 to rotate at 2,800 rpm (S30), and thereafter stops the motor 5 (S32).

In the interval IC3, as in the case of the interval IC1, the CPU 70 determines that the pressure is lower than 3.2 MPa at a time TC2 (YES in S108) and sets the value of the pressure flag to 0 (S114). The CPU 70 determines here that the pressure change rate is higher than −0.05/3 (MPa/sec) for the second time in a row (YES in S111) and thus sets the sub-mode to C (S112). In an interval IC4, the CPU 70 restarts the motor 5 (S18) and causes the motor 5 to rotate at 2,000 rpm corresponding to the setting of the sub-mode C (S30).

In an interval IC5, the pressure change rate is higher than −0.05/3 (MPa/sec) (NO in S152), so that the value of the pressure flag is kept at 1, and the motor 5 is not restarted until a time TC3. At the time TC3, when the CPU 70 determines that the pressure is lower than 2.3 MPa (YES in S150), the values of both the pressure flag and the pressure change rate flag are set to 0 (S160). Then, in an interval IC6, the CPU 70 restarts the motor 5 (S18) and causes the motor to rotate at 2,000 rpm (S30). In an interval IC7, the CPU 70 determines that the pressure change rate is equal to or lower than −0.05/3 (MPa/sec) (YES in S152) and sets the sub-mode to B (S154).

In a case where the pressure change rate has been determined to be higher than −0.05/3 (MPa/sec) for the second time in a row, the air is consumed slowly. In this case, the sub-mode is switched from B to C to cause the motor 5 to rotate at 2,000 rpm. Since the air is consumed slowly, the 2,000 rpm rotation of the motor 5 can supply sufficient air. The rotational speed of the motor 5 is reduced from 2,800 rpm to 2,000 rpm, thereby reducing noise and heat generated from the motor 5.

As described above, the appropriate switching of the sub-mode in the learning mode allows compressed air to be supplied according to the user's usage (air consumption amount).

Figure 8:
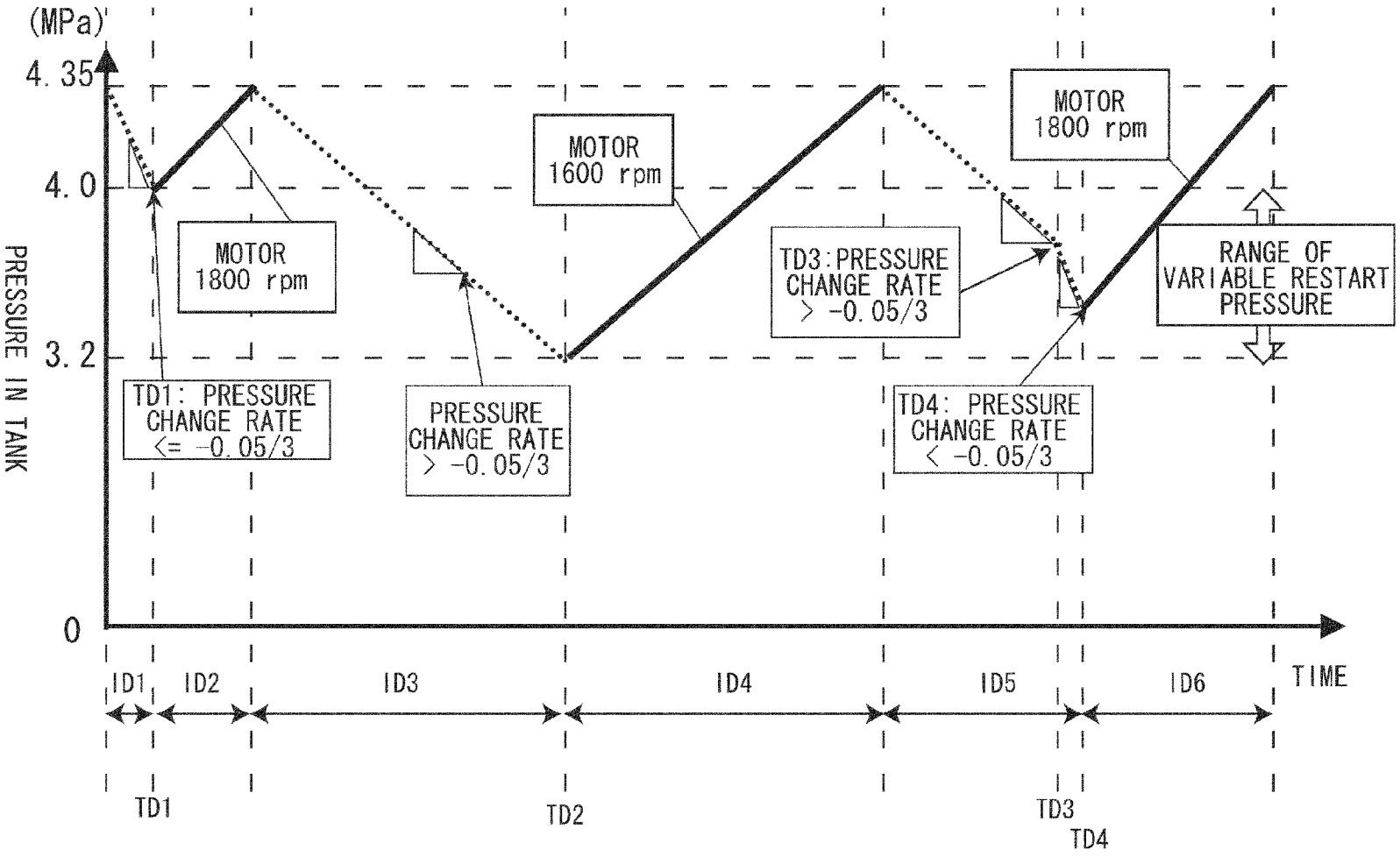
FIG. 8 is a timing chart illustrating processing performed in a silent mode.

The following describes the silent mode based on the control processing described above with reference to FIG. 8. In FIG. 8, a horizontal axis represents a time, and a vertical axis represents a pressure (MPa). The silent mode is executed when the user sets the switch 77 to the silent mode. Note that time 0 in FIG. 8 represents a state where the tank 50 is filled with air and motor 5 is stopped (S32).

In an interval ID1, the pressure change rate is equal to or lower than −0.05/3 (MPa/sec). Accordingly, at a time TD1, an affirmative determination is made in S106, and the values of the pressure flag and the pressure change rate flag are set to 0 and 1, respectively (S130). As a result, in an interval ID2, the CPU 70 starts the motor 5 (S18), causes the motor 5 to rotate at 1,800 rpm (S28), and thereafter stops the motor 5 (S32).

In an interval ID3, the pressure change rate is higher than −0.05/3 (MPa/sec), so that a negative determination is made in S106. At a time TD2, the CPU 70 determines that the pressure is lower than 3.2 MPa (YES in S108) and sets the values of both the pressure flag and the pressure change rate flag to 0 (S114). As a result, in an interval ID4, the CPU 70 starts the motor 5 (S18) and causes the motor 5 to rotate at 1,600 rpm (S28).

At a time TD3 in internal ID5, the pressure change rate is higher than −0.05/3 (MPa/sec) (NO in S106), so that the motor 5 is not restarted. However, at a time TD4, the pressure change rate is equal to or lower than −0.05/3 (MPa/sec) (YES in S106), and the pressure of air in the tank 50 is lower than 4.0 MPa (YES in S120), so that the values of the pressure flag and the pressure change rate flag are set to 0 and 1, respectively in S130. As a result, in an interval ID6, the CPU 70 starts the motor 5, causes the motor 5 to rotate at 1,800 rpm (S28), and thereafter stops the motor 5 (S32).

As described above, in the silent mode, when the pressure is lower than 4.0 and higher than 3.2 MPa, the motor 5 is restarted under the condition that the pressure change rate becomes equal to or lower than −0.05/3 (MPa/sec) and is caused to rotate at 1,800 rpm. Thus, as compared to a case where the motor 5 is not restarted until the pressure reaches 3.2 MPa irrespective of the pressure change rate, the continuous use time of the air compressor 1 can be increased. Further, when the pressure change rate is higher than −0.05/3 (MPa/sec), the motor 5 is restarted under the condition that the pressure is less than 3.2 MPa and is caused to rotate at 1,600 rpm. That is, in the silent mode, the motor 5 is caused to rotate at two different speeds of 1,600 rpm and 1,800 rpm according to the pressure change rate. This allows, in the silent mode, the motor 5 to rotate adequately according to the usage of the air compressor 1 and the continuous use time of the air compressor 1 to be increased while reducing noise, thereby providing a satisfactory response to user requirements according to the usage.

Further, in the silent mode, the motor 5 rotates at 1,800 rpm. This is slower than the maximum rotational speed of 2,800 rpm by 1,000 rpm. When the present inventor measured operating noise from the motor 5, operating noise of about 62 dB was obtained for 2,800 rpm, and 60 dB was for 1,800 rpm. Accordingly, multiplication of the rotational speed by about 0.64 (=1800/2800 times) reduces the operating noise by 2 dB. That is, the operating noise can be reduced by 1/100. Thus, a reduction of the rotational speed to 1,800 rpm is effective for reducing the operating noise. In a case where the air compressor is used in a residential area, an occurrence of large operating noise may annoy people living in the residential area. When the rotational speed of the motor 5 is reduced to 1,800 rpm, the operating noise is considerably reduced, thereby keeping the people in the area from being annoyed. In the present embodiment, when the pressure change rate becomes equal to or lower than −0.05/3 (MPa/sec), the motor 5 is restarted at the reduced rotational speed 1,800 rmp. This allows an increase in the continuous use time of the air compressor 1 while reducing the operating noise. Note that when the rotational speed of the motor 5 is reduced to 1,600 rpm in the silent mode, the noise can further be reduced as compared to a case where the motor 5 is caused to rotate at 1,800 rpm.

Further, in the silent mode, a value of the pressure at which the motor 5 is restarted is set in a range of 3.2 MPa to 4.0 MPa. The pressure value of this range is lower than the maximum pressure of 4.35 MPa of the tank 50. As a conceivable example of the silent mode, an air compressor in which the upper limit of a pressure value at which the motor 5 is restarted is the same as the maximum pressure of the tank is assumed. For example, assumed is a case where a pressure value for the restart is in a range of 3.2 MPa to 4.35 MPa and the maximum pressure of the tank is 4.35 MPa. In this case, when the pressure is reduced even slightly from 4.35 MPa, and when the pressure change rate is equal to or lower than −0.05/3 (MPa/sec) at that time, the motor is restarted. Accordingly, the motor is restarted immediately after start of the use of the air compressor. Further, the motor is restarted in a state where only a tiny amount of air has been consumed, so that the maximum pressure is reached at short times to stop the motor. This extremely reduces a time interval between the restart and stop of the motor. Such a behavior may be repeated depending on the user's usage. The motor operating noise repeated in such a short period of time annoys people around although the rotational speed of the motor is low. On the other hand, in the air compressor 1 according to the present embodiment, the pressure value for the restart of the motor is set in a range of 3.2 MPa to 4.0 MPa which is a pressure lower than the pressure value 4.35 for the restart of the motor. Thus, even when the pressure change rate is equal to or lower than −0.05/3 (MPa/sec), the motor 5 is restarted after a while from the start of the use of the air compressor. This causes less annoyance for people around than in the comparative example.

While the invention has been described in detail with reference to the embodiment thereof, it would be apparent to those skilled in the art that various changes and modifications may be made therein without departing from the scope of the invention.

For example, the CPU 70 determines in S111 that pressure change rate has been determined in S106 to be higher than −0.05/3 (MPa/sec) for the second time in a row. Alternatively, however, the sub-mode may be switched to C in S112 when the pressure change rate is determined to be higher than −0.05/3 (MPa/sec) even once in S106. In this case, the processing of S111 is omitted.

Alternatively, the CPU 70 may determine in S111 whether the pressure change rate has been determined in S106 to be higher than −0.05/3 (MPa/sec) a given number of times in a row.

Similarly, the sub-mode may be switched to C in S112 when the pressure change rate is determined to be higher than −0.05/3 (MPa/sec) even once in S138. In this case, the processing of S142 is omitted. Alternatively, the CPU 70 may determine in S142 whether the pressure change rate is higher than −0.05/3 (MPa/sec) a given number of times in a row.

Further, the sub-mode may be switched to A in S129 when the CPU 70 determines even once that the motor has been restarted in a state where the value of the 4.0 MPa flag is 1. In this case, the processing of S128 is omitted. Alternatively, the CPU 70 may determine in S128 whether the motor has been restarted in a state where the value of the 4.0 MPa flag is 1 a given number of times in a row.

INDUSTRIAL APPLICABILITY

The air compressor according to the present invention is especially useful in the field of a portable type air compressor that supplies compressed air to a pneumatic tool that uses the compressed air as a power source.

The invention claimed is:

1. An air compressor comprising:

a tank configured to accommodate compressed air having a pressure;

a compression mechanism configured to supply compressed air to the tank;

a motor configured to drive the compression mechanism; and a control circuit, wherein the control circuit selects one of a plurality of modes, each of the plurality of modes having a rotational speed of the motor and a reference restart pressure, the plurality of modes including a first mode and a second mode, the first mode having a first rotational speed as the rotational speed of the motor and a first reference restart pressure as the reference restart pressure, the second mode having a second rotational speed as the rotational speed of the motor and a second reference restart pressure as the reference restart pressure, the first mode and the second mode being defined so that at least one of a first condition and a second condition is satisfied, the first condition being that the first rotational speed is faster than the second rotational speed, the second condition being that the first reference restart pressure is higher than the second reference restart pressure;

wherein the control circuit executes one of the plurality of modes as a target mode in which the control circuit controls the motor to restart by comparing the reference restart pressure corresponding to the target mode with the pressure of the compressed air in the tank and rotates the motor at the rotational speed corresponding to the target mode; and wherein the control circuit automatically changes the target mode to the second mode from the first mode when the control circuit detects, a prescribed first number of times, a pressure change rate of the compressed air in the tank larger than a prescribed rate value.

2. The air compressor according to claim 1, wherein the control circuit changes the target mode from the one of the plurality of modes to another one of the plurality of modes based on at least one of the pressure of the compressed air in the tank and the pressure change rate of the compressed air in the tank.

3. The air compressor according to claim 1, further comprising a storing unit that stores history information indicating a history of an operation state of the air compressor, wherein the control circuit sets the reference restart pressure to a first pressure value when the history information satisfies a prescribed condition indicating that consumption rate of the compressed air in the tank is larger than a prescribed value, wherein the control circuit sets the reference restart pressure to a second pressure value smaller than the first pressure value when the history information does not satisfy the prescribed condition.

4. The air compressor according to claim 1, further comprising a storing unit that stores history information indicating a history of an operation state of the air compressor, wherein the control circuit sets a rotational speed of the motor to the first rotational speed when the history information satisfies a prescribed condition indicating that a consumption rate of the compressed air in the tank is larger than a prescribed value, wherein the control circuit sets the rotational speed of the motor to the second rotational speed slower than the first rotational speed when the history information does not satisfy the prescribed condition.

5. The air compressor according to claim 1, wherein the control circuit changes the target mode based on an operation state of the air compressor at a time when the motor is restarted.

6. The air compressor according to claim 1, wherein the control circuit stops the motor when the pressure of the compressed air becomes a maximum pressure value, wherein the motor rotates at a rotational speed slower than or equal to a maximum rotational speed, wherein the first mode has a first reference pressure smaller than the maximum pressure value and a second reference pressure smaller than the first reference pressure, wherein in the first mode, the control circuit restarts the motor to rotate at the maximum rotational speed when the pressure of the compressed air in the tank is between the first reference pressure and the second reference pressure, and the pressure change rate of the compressed air in the tank is smaller than or equal to a prescribed rate value.

7. The air compressor according to claim 6, wherein the second reference restart pressure is smaller than the second reference pressure and the second rotational speed is smaller than the maximum speed.

8. The air compressor according to claim 1, wherein the control circuit controls the motor to rotate at a rotational speed slower than or equal to a maximum rotational speed, wherein the plurality of modes further includes a third mode in which the motor rotates at the maximum rotational speed, wherein the control circuit automatically changes the target mode to the third mode when the control circuit detects, a prescribed second number of times, the pressure change rate of the compressed air in the tank smaller than a prescribed rate.

9. The air compressor according to claim 1, wherein the control circuit controls the motor to rotate at the rotational speed slower than or equal to a maximum rotational speed, and stops the motor when the pressure of the compressed air in the tank reaches a maximum pressure value, wherein the control circuit selects one of the first rotational speed and the second rotational speed based on the pressure change rate of the compressed air in the tank, and controls the motor to rotate at the selected one of the first rotational speed and the second rotational speed, the first rotational speed being slower than the maximum rotational speed, the second rotational speed being lower than the first rotational speed.

10. The air compressor according to claim 9, wherein the control circuit controls the motor to rotate at the first rotational speed when the pressure of the compressed air in the tank is a first pressure value lower than the maximum pressure value and the pressure change rate of the compressed air in the tank is smaller than or equal to a prescribed rate value, wherein the control circuit controls the motor to rotate at the second rotational speed when the pressure of the compressed air in the tank is a second pressure value lower than the first pressure value and the pressure change rate of the compressed air in the tank is larger than the prescribed rate value.

11. The air compressor according to claim 1, wherein the control circuit controls the motor to rotate at the rotational speed slower than or equal to a maximum rotational speed, and stops the motor when the compressed air becomes a maximum pressure value.

* * * * *